US006597264B2

(12) United States Patent
Barba Gea et al.

(10) Patent No.: US 6,597,264 B2
(45) Date of Patent: Jul. 22, 2003

(54) HIGH PERFORMANCE MICROWAVE FILTER

(75) Inventors: Mariano Barba Gea, Madrid (ES); Jose Luis Caceres Armendariz, Madrid (ES); Manuel Jesus Padilla Cruz, Madrid (ES); Isidro Hidalgo Carpintero, Madrid (ES)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/025,686

(22) Filed: Dec. 26, 2001

(65) Prior Publication Data

US 2002/0105394 A1 Aug. 8, 2002

(30) Foreign Application Priority Data

Dec. 29, 2000 (ES) ..... 200003144

(51) Int. Cl.[7] ..... H01P 1/201; H01P 1/208
(52) U.S. Cl. ..... 333/202; 333/219.1
(58) Field of Search ..... 333/202, 212, 333/219.1

(56) References Cited

U.S. PATENT DOCUMENTS 5,608,363 A * 3/1997 Cameron et al. ..... 333/202
6,351,193 B1 * 2/2002 Caceres Armendartz et al. ..... 333/202

FOREIGN PATENT DOCUMENTS

EP 1017122 A2 * 7/2000
JP 61-004302 A * 1/1986

OTHER PUBLICATIONS

Liang et al., "Mixed Modes Dielectric Resonator Filters", IEEE trans. on Microwave Theolry and Techniques, vol., 42, No. 12, Dec. 1994, pp. 2449–2454.*
Wang et al., "Mixed Modeds Cylindrical Planar Dielectric Resonator Filters with Rectangular Enclosure", IEEE trans. on Microwave Theolry and Techniques, vol., 43, No. 12, Dec. 1995, pp. 2817–2823.*

* cited by examiner

*Primary Examiner*—Seungsook Ham
(74) *Attorney, Agent, or Firm*—Sughrue Mion, PLLC

(57) ABSTRACT

High performance microwave filter with monomode resonators, said filter having a resonant frequency that corresponds to an electromagnetic resonance mode of an hybrid electromagnetic family comprising electric and magnetic field patterns. The filter is characterised in that it is capable of producing perturbation in a respective electric field (a2; b2) of two of said adjacent resonators, giving rise to a coupling of relatively high magnitude between the unperturbed electric fields (a1; b1).

10 Claims, 3 Drawing Sheets

HIGH PERFORMANCE MICROWAVE FILTER

The present invention relates to a high performance microwave filter. More specifically, the invention concerns the design and development of microwave filters particularly suitable for use in input or output multiplexers for broadband communications channels in satellite transmission systems, these filters being physically embodied by means of dielectric resonators included in metallic cavities of arbitrary shape, coupled with each other by means of windows, probes or loops.

BACKGROUND OF THE INVENTION

The new demands for communications services in relation with multimedia applications make it necessary to employ increasingly wide communication channels in satellite transmission systems, which implies the use, in various subsystems of the satellite communications payload, of microwave filters with bandwidths several orders of magnitude greater than those habitually used up to now, that is, passing from the current relative bandwidths of approximately 0.6%, to bandwidths of 2% (bandwidths of 300 MHz to 14 GHz).

Said applications require tight electrical specifications that involve highly complex filter transfer functions, as well as requiring reduced dimensions and mass because they are intended for space applications.

There exist various conventional solutions that permit a larger bandwidth to be obtained, e.g. dielectric resonator filters and waveguide resonator filters. Nevertheless, said solutions have drawbacks, either for their poor electrical properties with regard to quality factor, temperature stability and close spurious signals (and consequently in-band distortion), or else by having relatively large dimensions and weights.

Filters based on dielectric resonators have been extensively employed in space applications for reasons of their low mass, high temperature stability of the electrical characteristics, and superior electrical properties with regard to their high quality factor, low spurious signals and facility for implementing complex transfer functions.

The monomode configuration that is habitually employed, is that based on the fundamental mode, mode $TE_{01\delta}$, and obtains the transmission and equalisation zeros through cross couplings, the couplings being implemented with irises, probes, loops, etc. The greatest difficulty with this technique lies in that in order to be able to attain the new bandwidths necessary (≈2% of relative bandwidth) recourse has to be made to geometries that consist in bringing the dielectric resonator positions closer together. These geometries have the drawback of having a poorer quality factor and greater variation with temperature of the electrical parameters in comparison with those employed for narrower bandwidths. In addition, due to the restrictions in design imposed by these geometries, it is impossible or very costly, from the point of view of design, factory production and adjustment, to guarantee the absence of spurious modes very close to or inside the passband, which in the end signifies that their electrical properties are degraded, impeding compliance with the specifications.

On the other hand, recourse has also been made to dual mode configurations, in which two modes are generated in a single cavity; some of said configurations being the following:

that which uses two degenerated HEM modes, that which uses the $TE_{01\delta}$ and $TM_{01\delta}$ modes, and that which uses the $TE_{01\delta}$ and the $HEM_{11\delta}$ modes, or to monomode hybrid filters also called "mixed-mode", which comprise some cavities working with the $TE_{01\delta}$ mode and other cavities working with the $HEM_{11\delta}$ mode, or whatever other combination of different modes. In this case, it is a question of a monomode configuration, understanding this to mean that in each of the cavities there only exists one mode.

These last two configurations (dual and mixed-mode) offer the same drawbacks as already expounded for the $TE_{01\delta}$ monomode configuration in relation with quality factor, poorer stability with temperature of the electrical parameters or distortion in the passband due to spurious modes very close to or inside the passband.

Another technique employed in the embodiment of microwave filters for space applications, with which filters having larger bandwidths are obtained, is that based on empty metallic cavities. This technique, however, suffers the drawbacks of filters with greater size and mass, if equivalent electrical properties are desired, and is more complicated to design than that with dielectric resonators.

Thus, it is necessary to facilitate a microwave filter of reduced size and weight, the configuration of which permits the design of filters with a very broad range of bandwidths, whilst having the excellent electrical properties required by the tight specifications for satellite communications channels. The high performance microwave filter of the present invention has the characteristics necessary to reach this objective.

DESCRIPTION OF THE INVENTION

The invention herein proposed permits the embodiment, in a simple manner, of microwave filters for communications channels in space applications reaching the bandwidths needed for the new requirements, especially those in relation with multimedia applications, which, with respect to the conventional channels known in this art, increase the bandwidth specifications by various orders of magnitude. These applications impose electrical specifications that imply the need to implement complex transfer functions which can include transmission and/or equalisation zeros.

The solution proposed by the present invention permits the bandwidth required by the new applications to be attained, whilst permitting a complex response and adequate properties, both in-band (variation of insertion loss, variation in group delay, etc.) and out-of-band (rejection), to comply with the tight electrical specifications of satellite communications channels. Said solution also retains the advantages of using filters based on dielectric resonators, that is, those that make possible filters of reduced size and mass, with high temperature stability and with a high value of quality factor.

The solution proposed by the present invention for achieving the features described consists of filters embodied by means of the coupled resonator technique. In the present invention, said resonators are of the monomode type, that is, in each resonator there is a single resonance at the central frequency of the filter (which is that which is used for obtaining the desired filter response) due to a single resonant mode that is the same for all the resonators, and the resonance products due to the remaining resonant modes are located at a frequency sufficiently removed as not to produce distortion in the desired filter response. Each one of said resonators (hereinafter composite resonator) is, in turn, formed by a metallic cavity and by a resonant element (also termed dielectric resonator) formed by a material of high dielectric constant situated in the center of the metallic cavity by means of a support formed by a material typically of very low dielectric constant. The dimensions and geometries of the metallic cavity, of the resonant element and of the support of the resonant element are designed in order to satisfy the following conditions:

- in each composite resonator only one resonance is produced at the central frequency of the filter due to only one of the two originally degenerated orthogonal $HEM_{11}$ modes, considering as such the modes which within the composite resonator have the electric field pattern shown in the figures (FIG. 1).
- the resonance products due to the remaining resonant modes, including for example the $HEM_{11}$ mode which is not employed for obtaining the filter response, are located at a frequency sufficiently removed as not to distort the desired filter response.

The couplings between the multiple composite resonators that can form the filter are embodied by means of capacitive irises, inductive irises, capacitive probes, inductive loops or other means of coupling, that is, which permit electromagnetic energy to pass from one composite resonator to another.

It also has an input coupling and another output coupling embodied by means of capacitive irises, inductive irises, capacitive probes, inductive loops or other means of coupling for permitting the entry of electromagnetic energy into a composite resonator and the egress thereof from a composite resonator other than that of entry.

Thus, an object of the present invention is that of providing a microwave filter comprising a plurality of composite resonators each one comprising a cavity and a dielectric resonator being housed within said cavity, and at least one coupling means between two composite resonators in adjacent arrangement, said composite resonators being of the monomode type and having a resonant frequency that corresponds to a mode of electromagnetic resonance of an hybrid electromagnetic family comprising electric field and magnetic field patterns, characterised in that:

- at least two dielectric resonators of adjacent cavities are located in a same reference plane or in parallel reference planes, said reference plane being that which sections the dielectric resonator into two symmetrical halves and on which the field patterns of the two degenerated orthogonal modes are essentially equal turned through 90° with respect to each other;
- a respective originally degenerated resonant mode of each one of said resonators is perturbed by altering its resonant frequency; and
- the filter offers a main path for the signal that traverses the composite resonators coupled in sequential manner and at least one alternative path for the signal provided by at least one cross coupling between two composite resonators spatially adjacent and not consecutive in the sequence that defines the main path of the signal.

According to one aspect of the invention, the respective electric field patterns of each substantially unperturbed resonant mode of said composite resonators are in a parallel arrangement.

According to another aspect of the invention, said respective field patterns of the substantially unperturbed modes are oriented in such a manner that the directions of the electric field in the center of the composite resonators are also arranged perpendicular to the direction of a coupling furnished by a coupling means between said resonators.

According to another aspect of the invention, said respective field patterns of the substantially unperturbed modes are oriented in such a manner that the directions of the electric field in the center of the composite resonators are parallel and perpendicular to the plane that traverses a probe that serves as a coupling means between said resonators.

According to another aspect of the invention, said perturbation provoking a separation in resonant frequency of the orthogonal modes is obtained in the composite resonators of the filter by means of a cavity of asymmetrical geometric shape or of symmetrical geometric shape with an aspect ratio between the dimensions on the different axes of symmetry other than unity.

According to another aspect of the invention, said separation of orthogonal modes in the composite resonators of the filter is obtained by means of asymmetrical or off-centered arrangement of the dielectric resonator in a cavity.

According to another aspect of the invention, said separation of orthogonal modes in the composite resonators of the filter is obtained by means of positioning an adjustment element, like a slug or a post, arranged in an off-centered manner with respect to the center of the composite resonator.

According to another aspect of the invention, said separation of orthogonal modes in the composite resonators of the filter is obtained by means of whatever combination of the aforementioned perturbations.

According to another aspect of the invention, said separation of orthogonal modes is obtained by using composite resonators of different types from among those described above.

This and other characteristics of the invention are described in greater detail below with the help of the drawings attached.

DESCRIPTION OF A PREFERRED EMBODIMENT

Figure 1:
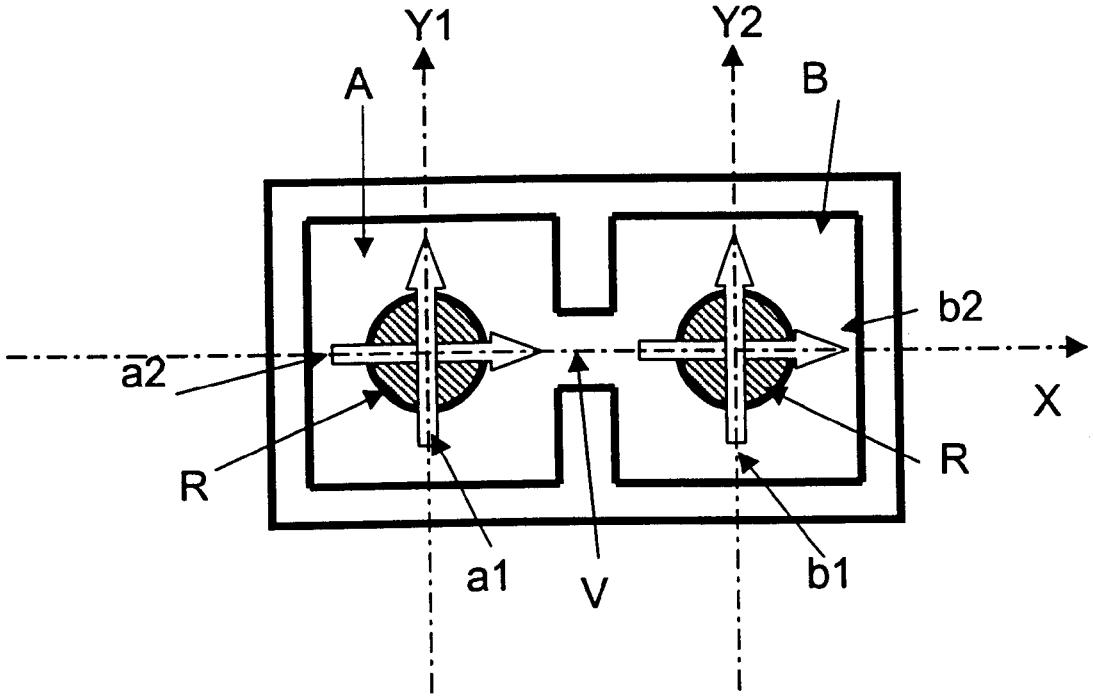
FIG. 1 is a top plan view according to a schematic representation of a microwave filter having two cavities that shows the state of symmetry between the electric field patterns of the composite resonators.

FIG. 1 shows an example of a microwave filter in which can be seen two cavities A and B, the cross section of which is substantially square in shape. Within each cavity, in a substantially centered manner, a dielectric resonator R is housed. Between cavity A and cavity B there is an iris in the form of a window V that permits coupling between the two dielectric resonators R. In the composite resonator formed by the cavity A and its respective dielectric resonator, resonant modes are excited, at the working frequency, of an electrically hybrid family with field patterns characterised by the electric fields in the center of the composite resonator a1 and a2, and in the composite resonator formed by the cavity B and its respective dielectric resonator, in similar fashion, resonant modes are excited of an electrically hybrid family with field patterns characterised by the electric fields in the centre of the composite resonator b1 and b2. As may be appreciated in FIG. 1, the field distribution in the total volume formed by each metallic cavity and its dielectric resonator is substantially the same for the modes characterised by a1 and a2 due to the symmetry of the cavity, but rotated through 90° with respect to each other; the same thing occurs with the modes characterised by b1 and b2. Because of this identical field distribution, the electrical and magnetic energies stored by mode a1 are equal to those of mode a2, for which reason their respective resonant frequencies are equal. In like manner, the resonant frequencies of b1 and b2 are equal. To the mode pairs a1–a2 and b1–b2 the term degenerated mode pairs is given because they have the same resonant frequency, and are orthogonal because their field patterns are rotated through 90° with respect to each other. To facilitate a better understanding, in the technique related to the present invention, a reference plane is defined, not shown in the figure, which is that which sections the dielectric resonator into two symmetrical halves and upon which the field patterns of the two degenerated orthogonal modes are the same and rotated through 90° with respect to each other. In this figure the reference plane which has been defined coincides with the plane of the paper.

The iris V permits the coupling of any resonant mode of cavity A with any resonant mode of cavity B. However, the coupling value depends on the field distributions of the resonant modes that are coupled. Thus, in the case of FIG. 1, whilst the coupling between the field modes a1 and b1 (parallel) has an adequate value for the bandwidth of the filter that it is intended to implement, the coupling between the field modes a2 and b2 does not attain a sufficient value and therefore they are undesired modes.

To prevent these undesired modes from distorting the filter response, a situation is provoked wherein the resonant frequency of the modes a2 and b2 is substantially removed from the central frequency of the filter. This is achieved by producing the perturbation of the resonant mode, for example by breaking an arrangement of symmetry between the respective dielectric resonator-cavity assemblies, which causes the field distributions of the modes a2 and b2 to differ from those of modes a1 and b1, and thereby their stored electrical and/or magnetic energies also differ, which signifies different resonant frequencies. The perturbation of a resonant mode must be understood in the sense that, by means thereof, the resonant frequency of said mode is altered and gives rise to the separation of the orthogonal modes.

Figure 2A:
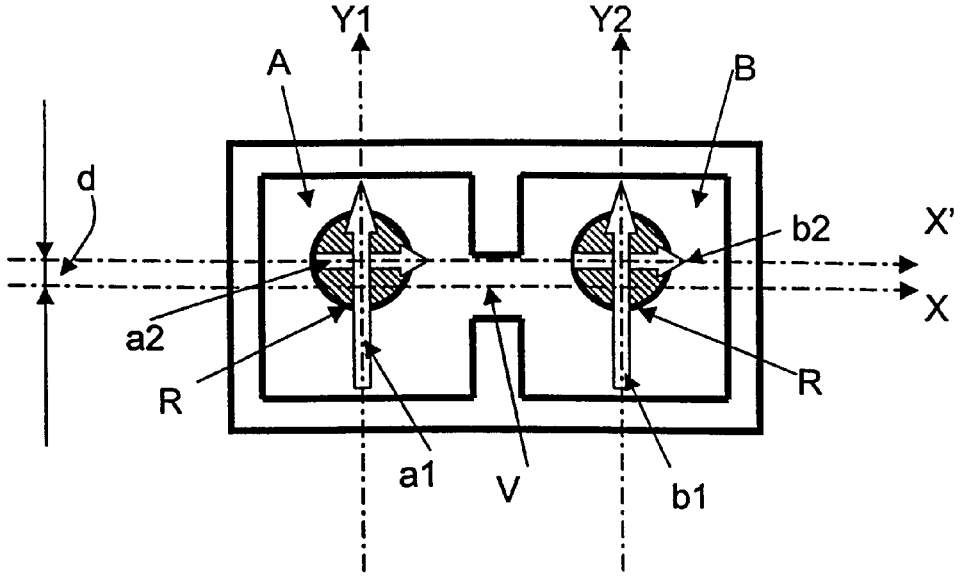
FIG. 2*a* represents the filter of FIG. 1 in which the symmetry has been perturbed by means of a displacement of the respective dielectric resonators.

An example of this solution can be observed in FIG. 2*a* in which can be seen the same filter as in FIG. 1 with the difference that the dielectric resonators R have been displaced in their position along the Y-axis, giving rise to a new axis of orientation X', which is to be found at a distance d from the previous position of the dielectric resonators that are shown on the X-axis and in a direction parallel thereto. As may be appreciated in FIG. 2*a,* the displacement of dielectric resonators R gives rise to a breaking of the symmetry that was present in the case of the filter of FIG. 1. This breaking of symmetry gives rise, in turn, to the perturbation of the electric fields, the patterns of which are represented by means of the arrows a2 and b2. On the other hand, the patterns of the electric fields a1 and b1 are oriented in parallel with each other and also in parallel to the geometric plane that the window V defines.

It has to be pointed out that one of the conditions for achieving maximum values of coupling is that the electric field patterns a1, a2, b1 and b2 of the composite resonators are in a same main plane or in parallel main planes. At least the field patterns a1 and b1 shall have to meet this condition.

Figure 2B:
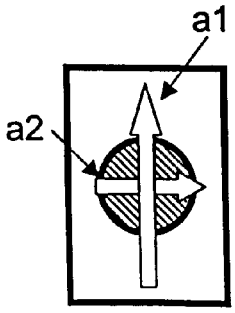
FIGS. 2*b,* 2*c* and 2*d* are alternative examples of embodiment of perturbations in the symmetry between the dielectric resonator-cavity assemblies.

Insofar as FIGS. 2*b,* 2*c* and 2*d* are concerned, like elements have like alphanumeric references.

FIG. 2*b* shows an alternative example of embodiment of a cavity-dielectric resonator assembly in which the cross section of said cavity is rectangular, and not square, giving rise to the perturbation of the electric field whose pattern is identified by means of the reference a2.

Figure 2C:
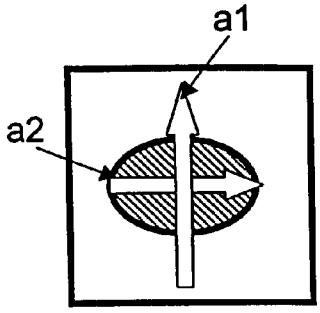

Another example of alternative embodiment is shown in FIG. 2*c* in which the perturbation is achieved by means of the use of an elliptic dielectric resonator, instead of the circular dielectric resonator of FIG. 2*a*.

Figure 2D:
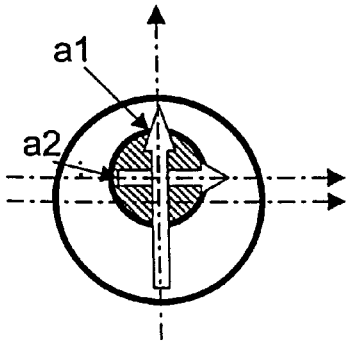

Another example of alternative embodiment is shown in FIG. 2*d* in which both the cavity and the dielectric resonator have a circular cross section and the perturbation is achieved by displacing the dielectric resonator towards one side of the cavity as may be appreciated by making use of displacement axes.

It is to be noted that the examples of FIGS. 2*a,* 2*b,* 2*c* and 2*d* are presented only by way of illustration and not restrictively, for which reason it is to be understood that other forms or other means for producing perturbation, like for example using resonance setting slugs or other conventionally known means shall also be valid for the objectives of the solution proposed herein.

Figure 3:
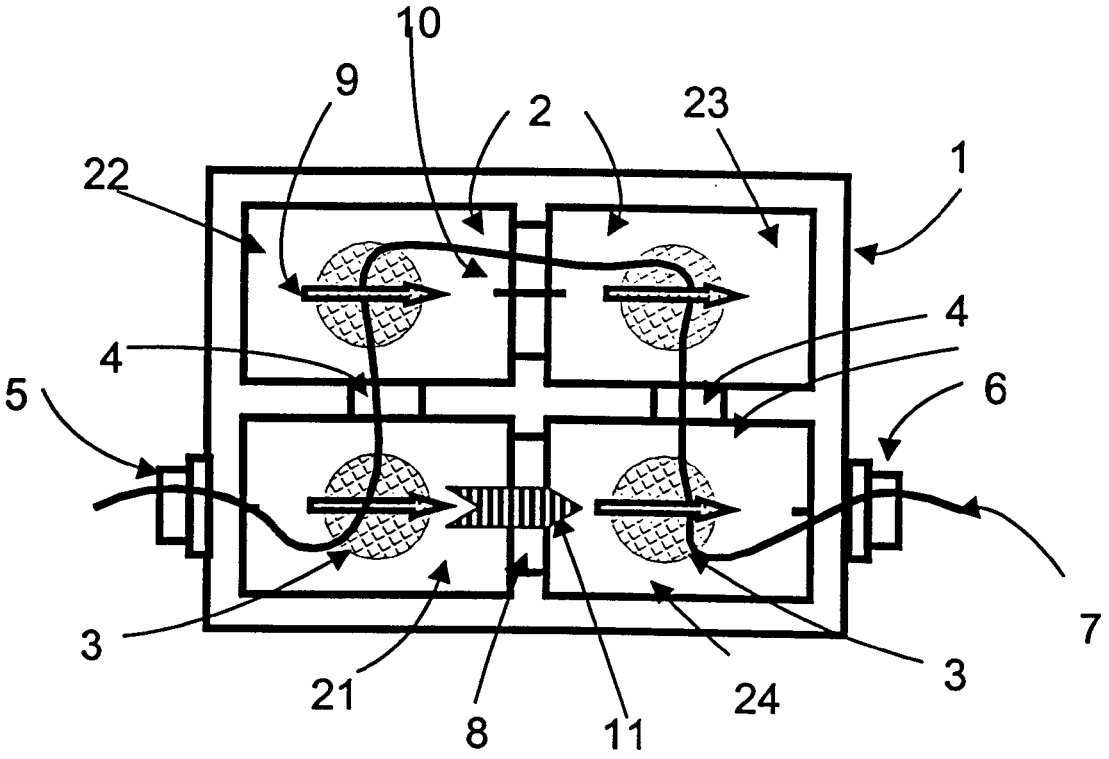
FIG. 3 represents an example of a four-cavity filter according to the present invention.

In FIG. 3 an example is shown of a microwave filter 1 with four cavities 21, 22, 23 and 24, also represented by means of general reference 2, in each one of which a dielectric resonator 3 is arranged. The cavities 21 and 22, and also 23 and 24, communicate with each other by means of respective windows 4; the cavities 22 and 23 communicate with each other by means of a probe 10 and the cavities 21 and 24 communicate with each other by means of another window 8. In the case of this example, the perturbation is achieved through the use of rectangular, instead of square, cavities, giving rise to electric field patterns 9 in order to achieve the high values of coupling necessary.

The filter can include adjustment means, for example slugs above each window and above or to the side of each dielectric resonator, in order to permit fine setting in the final response of the filter.

With this arrangement, the wave enters the cavity 21 through the port 5, which can comprise any means for introducing the signal, like for example a probe, passing through the dielectric resonator 3 and cavity 21 assembly. Between the composite resonators implemented in the cavities 21 and 22 a coupling of relatively large magnitude is produced due to the presence of the electric fields 9 in a parallel arrangement and the perturbation of the respective components of electric fields orthogonal thereto.

Next, a coupling is produced between the composite resonators implemented in the cavities 22 and 23, by means of use of the probe 10, of value comparable to that which is produced between the composite resonators implemented in the cavities 21 and 22, for passing the wave thereafter from the composite resonator implemented in the cavity 23 to the composite resonator implemented in the cavity 24 through the window 4, giving rise once again to a coupling of relatively high magnitude. Finally, the wave continues its egress to the exterior of the filter through the output means 6 that can comprise whatever mechanism for signal extraction, like for example a probe. By way of illustration, the path followed by the wave is shown by means of line 7.

By means of the cross coupling provided by window 8, the electromagnetic energy has an alternative path, shown by the arrow 11, to the habitual path 7 which passes through all the composite resonators that form the filter permitting in this case that there be two symmetrical transmission zeros in the filter response. This coupling can be implemented between composite resonators with the field patterns collinear due to the fact that the cross couplings have values various orders of magnitude less than the remaining couplings of the filter.

In this manner, a filter capable of working in a single mode is obtained, that is HEM, producing bandwidths substantially greater than the filters known and with very strong coupling.

The dimensions of the cavities and of the dielectric resonators are chosen such that the central frequency of the filter coincides with the resonant frequency of a HEM mode.

The present invention provides important benefits with respect to the techniques habitually employed. Some of said benefits are listed hereunder:

By using dielectric resonators in cavities, the typical advantages are obtained that are possible with this type of filter. These are high stability with temperature, high quality factor and reduced size.

By concerning a monomode configuration with cross couplings, simplicity in the implementation of complex and pseudo-elliptic transfer functions is achieved.

Simplicity in adjustment.

By concerning a dominant mode, which is strongly coupled, high coupling values are achieved, which result in high-bandwidth filters.

The filter response obtained is very pure, with hardly any distortion, because, since this mode predominates over the rest, the presence of spurious effects is not appreciable.

With this type of filter, highly complex responses are obtained, like for example those termed pseudo-elliptic, with transmission zeros and equalisation zeros.

What is claimed is:

1. A microwave filter comprising a plurality of composite resonators each one comprising a cavity (A; B; 2) and a dielectric resonator (R;3) housed inside said cavity, and at least one coupling (V; 4, 8) between two adjacent composite resonators, said composite resonators being of the monomode type and having a resonant frequency that corresponds to a mode of electromagnetic resonance of a hybrid electromagnetic family comprising electric field and magnetic field patterns, wherein:

the dielectric resonators (R; 3) of at least two adjacent cavities are located in a same reference plane or in parallel reference planes, said reference plane being that which sections the dielectric resonator into two symmetrical halves and on which the electric field patterns (a1, a2) of degenerated orthogonal modes are essentially equal but turned through 90° with respect to each other;

a respective originally degenerated resonant mode of each one of said resonators is perturbed by altering its resonant frequency to thereby separate the resonant frequencies of the orthogonal modes in each of said composite resonators; and the filter has a main path (7) for a microwave signal that traverses the composite resonators in a first sequence and at least one alternative path (11) for the signal through said cross coupling and through at least some of said composite resonators in a second sequence different from said first sequence.

2. A filter according to claim 1, characterised in that respective electric field patterns (a1; b1) of each substantially unperturbed resonant mode of said composite resonators are in a parallel arrangement.

3. A filter according to claim 1, characterised in that respective electric field patterns (a1; b1) of substantially unperturbed resonant modes of said composite resonators are oriented in such a manner that the directions of the electric field in the centre of the composite resonators are also arranged perpendicular to the direction of a coupling between said composite resonators.

4. A filter according to claim 1, characterised in that respective electric field patterns of substantially unperturbed resonant modes of said composite resonators are oriented in such a manner that the directions of the electric field in the centre of the composite resonators are parallel and are perpendicular to a plane that traverses a probe that serves as said coupling between said resonators.

5. A filter according to claim 1, characterised in that said perturbation is obtained in the composite resonators of the filter by means of a cavity of asymmetrical geometric shape.

6. A filter according to claim 5, characterised in that said separation of orthogonal modes in the composite resonators of the filter is obtained by means of an asymmetric or off-centred arrangement of the dielectric resonator in the cavity.

7. A filter according to claim 5, characterised in that said separation of orthogonal modes in the composite resonators of the filter is obtained by positioning an adjustment element, arranged in an off-centred manner with respect to a centre of the composite resonator.

8. A filter according to claim 5, characterised in that, said separation of orthogonal modes in the composite resonators of the filter is obtained by means of an asymmetric or off-centred arrangement of the dielectric resonator in the cavity.

9. A filter according to claim 1, characterized in that said separation of orthogonal modes is obtained by the use of different types of composite resonators.

10. A filter according to claim 1, characterised in that said perturbation is obtained in the composite resonators of the filter by means of a cavity of geometric shape symmetric with respect to at least two axes of symmetry and wherein dimensions of said symmetric cavity along each of said two axes of symmetry are not equal.

* * * * *